United States Patent [19]

Giannini

[11] Patent Number: 4,860,364

[45] Date of Patent: Aug. 22, 1989

[54] SOUND GENERATING OUTERWEAR AND ASSOCIATED SWITCHES

[76] Inventor: Giancarlo Giannini, Via Giuseppe Mercalli 46, Rome, Italy

[21] Appl. No.: 651,865

[22] Filed: Sep. 17, 1984

[51] Int. Cl.[4] ..... G10H 5/00; H04R 1/02

[52] U.S. Cl. ..... 381/90; 84/1.01; 84/DIG. 17; 84/DIG. 8; 2/93; 2/227; 341/20

[58] Field of Search ..... 340/384 R, 384 E; 446/28, 303, 297; 84/1.01, 1.16, 267, 1.28, DIG. 7, DIG. 8; 2/69, 85, 90, 93–95, 160, 161 R, 161 A, 227; 273/183 R, 186 R, 183 B, 189 R; 381/87, 88, 90; 200/5 R, 5 A, 61.1, DIG. 2; 128/774, 782; 341/20–35

[56] References Cited

U.S. PATENT DOCUMENTS

| | | | |
|---|---|---|---|
| 3,901,118 | 8/1975 | Ford | 84/1.16 |
| 4,043,241 | 8/1937 | Liu | 446/26 |
| 4,320,573 | 3/1982 | Larson | 200/5 A X |
| 4,454,796 | 6/1984 | Inoue et al. | 84/1.28 X |
| 4,466,136 | 8/1984 | Bottom et al. | 84/267 |
| 4,488,726 | 12/1984 | Murray | 273/183 B |
| 4,539,700 | 9/1985 | Sato | 381/90 |

FOREIGN PATENT DOCUMENTS 2029070 3/1980 United Kingdom .

*Primary Examiner*—Stanley J. Witkowski

[57] ABSTRACT

A sound generating outer garment, such as a suit, a coat, or a jacket, includes switches and a sound generating circuit. The switches are connected to the sound generating circuit, and both the switches and the sound generating circuit are mounted in the garment. The sound generating circuit produces a sound or sounds in response to the actuation of one or more of the switches. Preferably, a switch is positioned at each shoulder and at each elbow of a coat or a jacket and at each knee of a pair of pants. The sound generating outer garment may also include a transmitter for transmitting the sound or sounds that are produced to an AM or FM receiver. Each switch may include a flexible and conductive first outer lamina and a flexible and insulating second outer lamina. Interposed between the two outer laminas is a resilient insulating cushion. The cushion has a number of holes formed through its thickness. Conductive projections are positioned on the second outer lamina in alignment with the holes formed in the cushion. These projections are electrically joined together so that if pressure is exerted anywhere on either outer lamina, one or more of the projections will contact the first outer lamina and complete the circuit through the switch. Mercury switches may also be employed in a sound generating outer garment.

11 Claims, 4 Drawing Sheets

FIG. 5
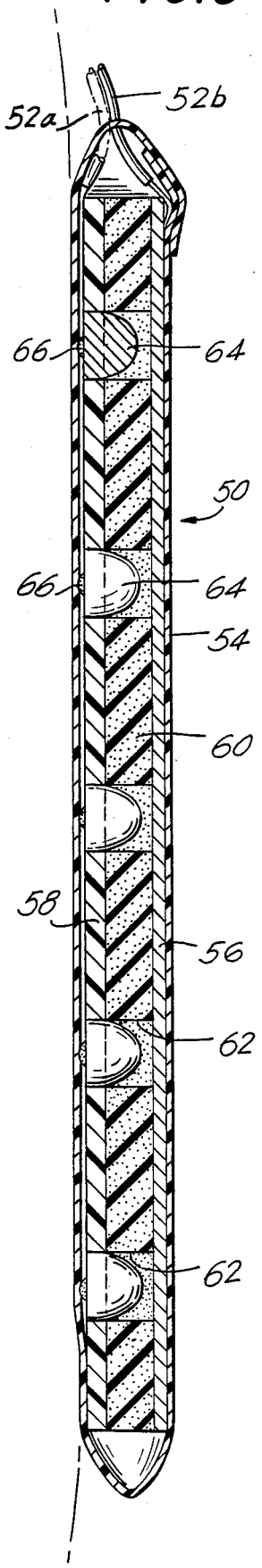
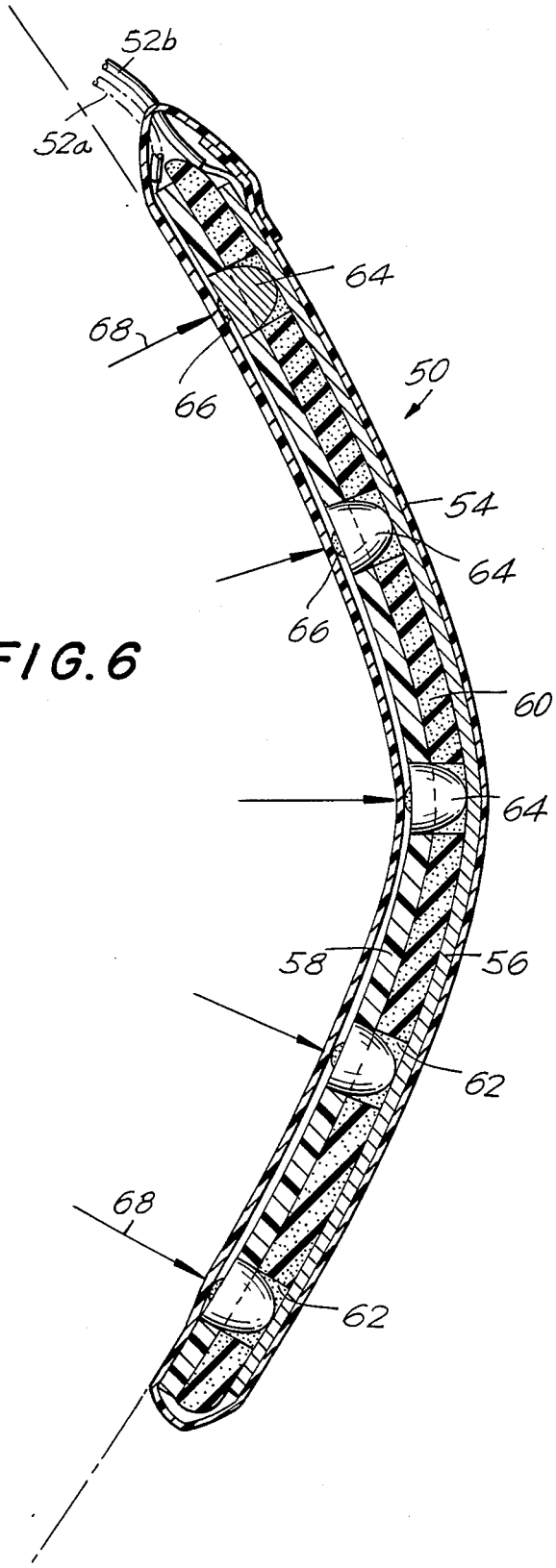
FIG. 6

SOUND GENERATING OUTERWEAR AND ASSOCIATED SWITCHES

BACKGROUND OF THE INVENTION

1. Field of the Invention

This invention relates to clothing which is adapted to produce a musical sound. More particularly, it pertains to sound generating outerwear, such as a suit, a coat, or a jacket, that includes switches, which, when selectively actuated by the wearer, will cause an audible sound to be produced.

2. Description of the Prior Art

It is well known in the art to provide various articles of clothing with movement sensing devices such that bodily movements actuate an electronic circuit. For example, U.S. Pat. No. 3,704,339, which issued to Naoyuki Niinomi, illustrates in FIGS. 11 through 13 various articles of clothing, such as socks, gloves, shirts, etc., having electrodes 96*a* and 96*b*. The electrodes pick up variations in bodily voltages caused by muscular contractions of the wearer of the article of clothing. The signals detected by the electrodes are sent to a muscular voltage processing circuit. The output of the muscular voltage processing circuit is supplied as a control signal to a tone modifying circuit.

There are many inherent drawbacks with the device disclosed in the Niinomi patent. One particular disadvantage of the device is that it relies on electrodes to detect bodily movements. The electrodes are placed against the skin of the wearer at selected muscular areas of the body. As mentioned previously, the electrodes detect minute voltages produced by muscular contractions. Because of the low amplitudes of the voltages that are detected, the electronic circuit of the Niinomi device is highly sensitive to the location of the electrodes. Moreover, the circuit may be desensitized when the electrodes are mounted in an article of clothing, especially if the article is loose fitting. Optimally, the electrodes should be placed against the skin with the aid of an electrically conductive paste or bonding tape, as disclosed at column 2, lines 54 through 59, of the Niinomi patent. However, the person's mobility if may be decreased the electrodes are positioned in this fashion.

A second disadvantage of the musical device disclosed in the Niinomi patent is the complexity of the circuit. Inasmuch as the device relies on the detection of voltage variations produced by muscular contractions, a complicated signal processing circuit is necessary. The complex circuit required to detect voltages due to muscular contractions may increase the manufacturer's cost of producing the device and may significantly add to the weight and size of the device. The voltage detection and manufacturing problems may be compounded if the Niinomi circuit is mounted in an article of clothing that is worn by the player, rather than mounted in a separate housing, such as the organ illustrated in FIG. 7A.

SUMMARY OF THE INVENTION

An object of the present invention is to provide musical or sound generating outerwear that reliably produces particular musical sounds in response to the movements of the wearer.

Another object of the present invention is to provide a sound generating outer garment in which the circuitry for detecting bodily movements and the circuitry for producing musical sounds are mounted entirely within the garment.

Yet another object of the present invention is to provide a switch adapted for use in a sound generating outer garment that can be easily controlled and actuated by the wearer of the garment.

The present invention overcomes the problems with and the disadvantages of the prior art. More specifically, it satisfies the need for a simple, uncomplicated, inexpensive, and reliable novelty that produces musical sounds in response to bodily movements. Moreover, a device according to the present invention is lightweight and readily portable.

A musical or sound generating outer garment according to the present invention includes a plurality of switches that are mounted in the garment and a sound generating circuit that is also mounted in the garment. Each of the switches is connected to the sound generating circuit, and it generates a sound or sounds in response to the actuation of one of the switches. In a jacket, for example, the switches may be positioned at each shoulder and at each elbow so that they are easily actuated by bodily movements. Preferably, the sound generating circuit generates a plurality of sounds, and each one of the switches uniquely corresponds to each one of the sounds.

A musical or sound generating outer garment according to the present invention advantageously includes a transmitter, which is mounted in the garment and connected to the sound generating circuit. The transmitter sends to a receiver signals corresponding to each of the sounds produced by the sound generating circuit. Preferably, the transmitter is disconnected from the sound generating circuit when it is not being used.

Additionally, a musical or sound generating outer garment according to the present invention may include a storage device that selectively stores and retrieves a representation of a series of sounds produced by the sound generating circuit. Accordingly, when desired, a representation of a series of sounds may be stored, and, when desired, the representation may be retrieved and used to reproduce the series of sounds.

A switch according to the present invention is particularly adapted for use in sound generating outerwear. Such a switch includes a flexible and conductive first outer lamina and a flexible and insulating second outer lamina. Interposed between the two outer laminas is a flexible and resilient insulating cushion. The cushion has a number of holes formed through its thickness. Conductive projections are positioned on the second outer lamina in alignment with the holes formed in the cushion. The projections are electrically joined together. Consequently, if sufficient pressure is exerted anywhere on either outer lamina, at least one of the projections will contact the first outer lamina and complete a circuit through the switch.

The above and other objects, features, and advantages of the present invention will be apparent from the following detailed description of an illustrative embodiment thereof, which is to be read in connection with the accompanying drawings.

BRIEF DESCRIPTION OF THE DRAWINGS

FIG. 5 is a cross-sectional view of the switch shown in FIG. 4 that is taken along lines 5—5 and illustrates the switch in its open or unactuated position.

FIG. 6 is a cross-sectional view of the switch shown in FIG. 4 that is taken along lines 5—5 and illustrates the switch in its closed or actuated position.

DETAILED DESCRIPTION OF THE PREFERRED EMBODIMENT

Figure 1:
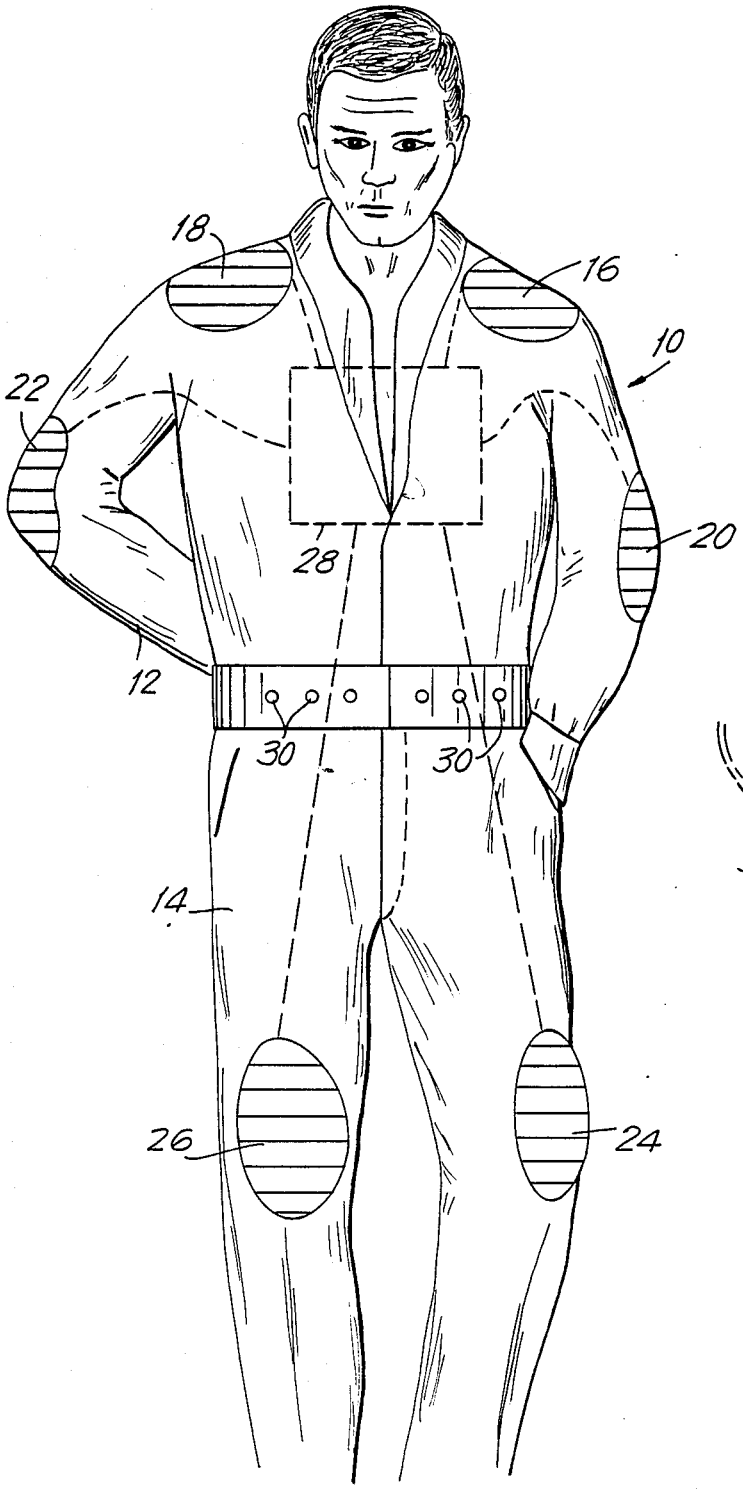
FIG. 1 is a perspective view of a sound generating suit according to the present invention.

Referring now to the drawings, and more particularly to FIG. 1, a sound generating suit according to the present invention is generally designated by the reference numeral 10. The suit 10 includes a jacket 12 and, optionally, a pair of pants 14. Switches 16 and 18 are mounted in the left and right shoulders, respectively, of the jacket 12, while switches 20 and 22 are mounted in the left and right elbows, respectively, of the jacket 12. Furthermore, switches 24 and 26 are mounted in the left and right knees, respectively, of the pair of pants 14. The switches 16 through 26 are sewn in place and connected by leads to a main control circuit 28, which is indicated in phantom. Control switches and control knobs 30, which may be employed, for example, to turn the main control circuit 28 on and off and to adjust the volume and tone of the sounds that are generated, are located at the waistband of the jacket 12.

The switches 16 through 26 are flexible switches and will be described in greater detail during the description of FIGS. 4 through 6, below. Accordingly, the wearer of the suit moves a shoulder or an elbow or a knee in order to close one of the switches 16 through 26. A switch closure is detected by the main control circuit 28, and it produces a sound in response. Preferably, the switches 16 and 18, which are located at the shoulders of the jacket 12, are more flexible or sensitive than the switches 20 and 22, which are located at the elbows of the jacket 12, and the switches 24 and 26, which are located at the knees of the pair of pants 14, inasmuch as moving an elbow or a knee is easier and produces more force than moving a shoulder. Although the suit 10 is shown and described as having flexible switches 16 through 26, other switch types may be utilized. For instance, mercury switches are also suitable.

Figure 2:
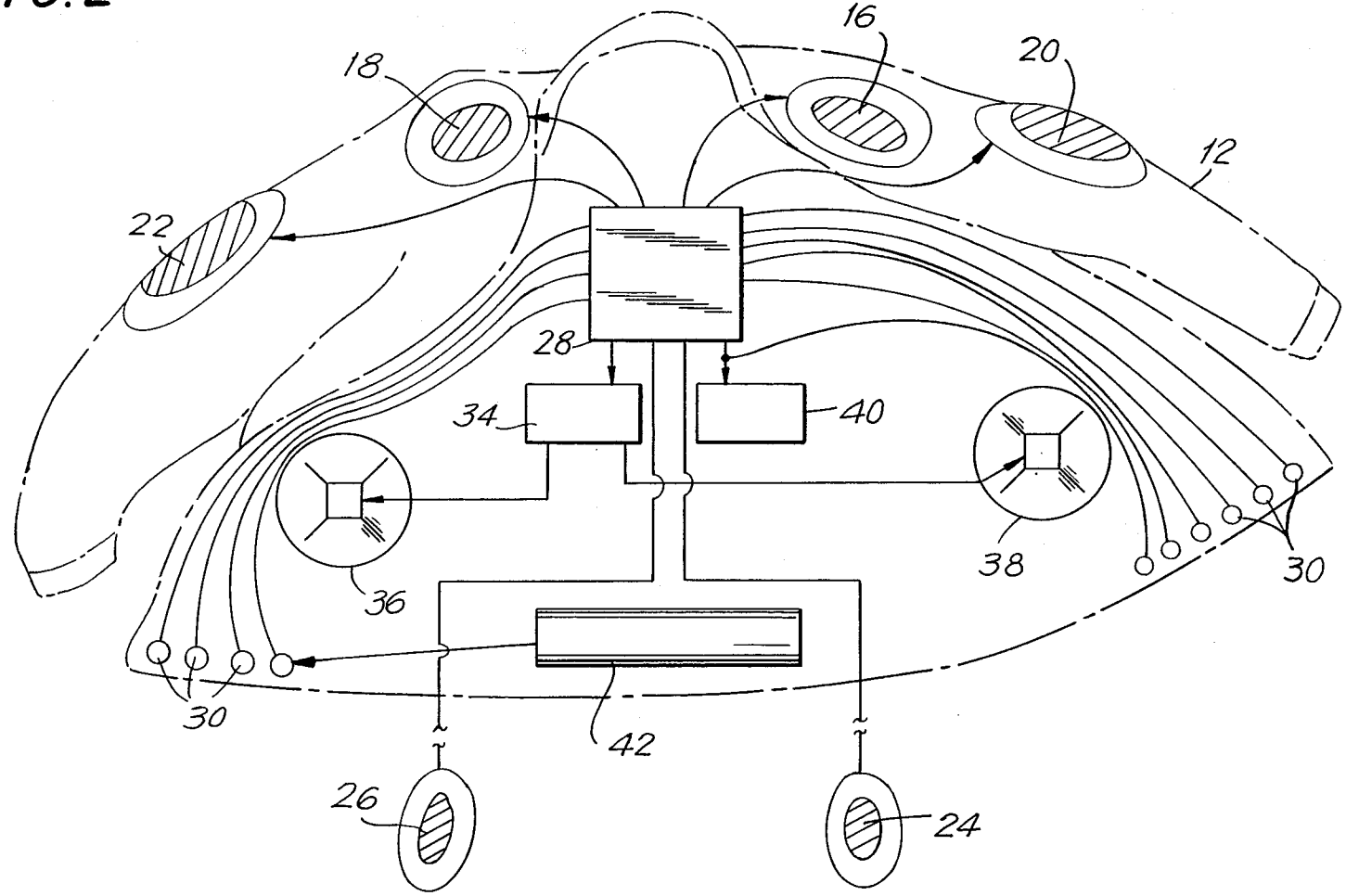
FIG. 2 is a diagrammatic illustration of a sound generating suit according to the present invention and shows the positions of the switches and other components in the suit.

FIG. 2 illustrates in greater detail the components of a sound generating suit according to the present invention. The components are mounted entirely within the suit 10. The switches 16 through 26 provide input signals to the main control circuit 28, and the main control circuit 28 provides output signals to an amplifier 34, which drives right and left speakers 36 and 38, respectively, and a transmitter 40. The main control circuit 28 includes a sound generating circuit that produces a sound when a switch is actuated. Each sound produced by the sound generating circuit is amplified by the amplifier 34 and supplied to the speakers 36 and 38. Each sound may be sent to a transmitter 40, which then transmits it to an AM or FM receiver, where it is amplified and provided to an external speaker or speakers. A battery pack 42 supplies power to the main control circuit 28 through one of the control switches 30.

Figure 3:
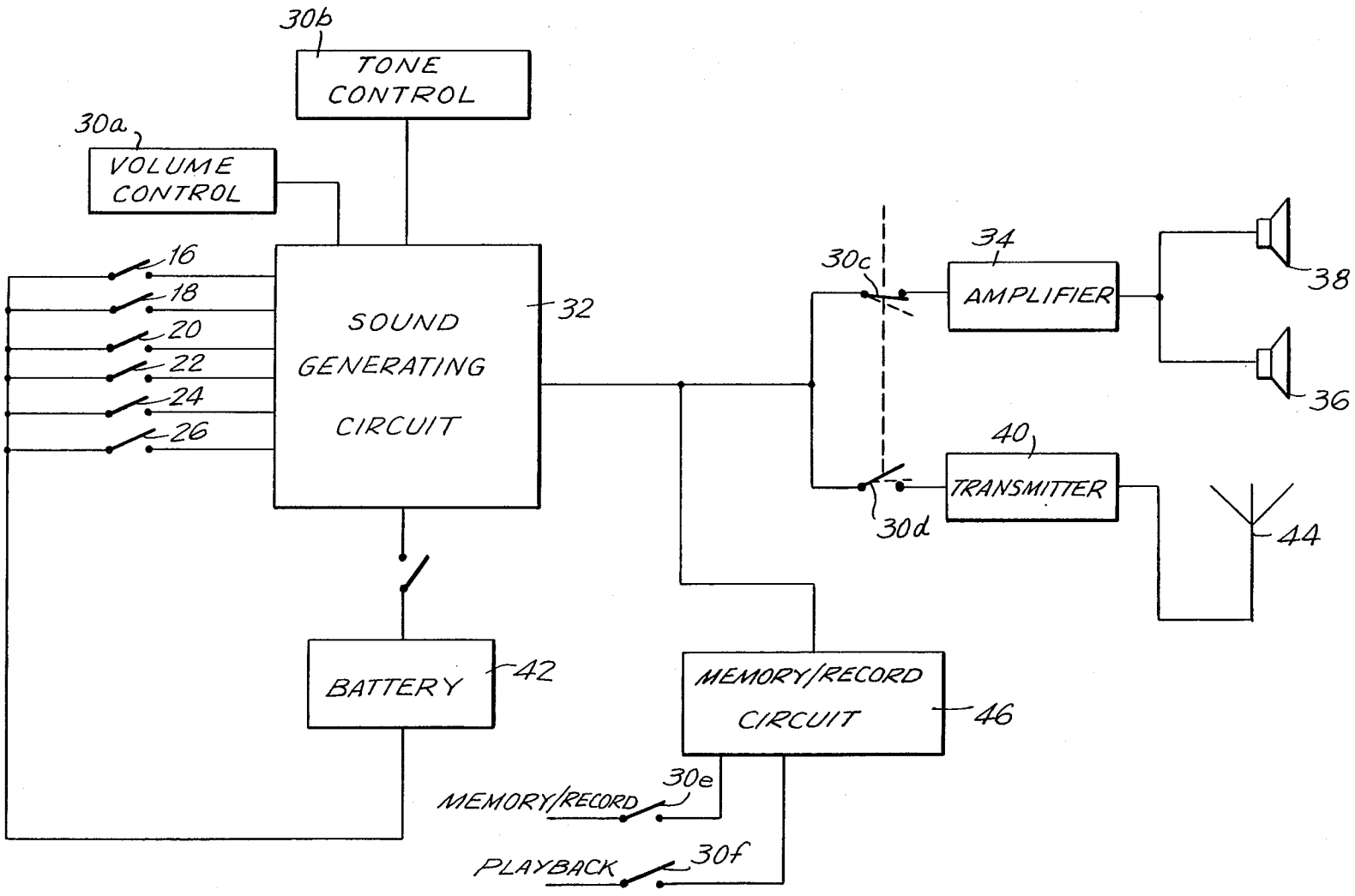
FIG. 3 is a block diagram of a circuit for a sound generating suit according to the present invention.

FIG. 3 is a block diagram of a circuit for a sound generating suit according to the present invention. The switches 16 through 26 are connected to a sound generating circuit 32. Preferably, the sound generating circuit 32 produces a different sound in response to the actuation of each different switch. In other words, each of the switches uniquely corresponds to each of the sounds. For instance, the sound generating circuit 32 may produce six different percussion or drum sounds, e.g., tom-tom, cymbal, snare, bongo, etc., sounds. Alternatively, the sound generating circuit 32 may produce six other sounds, such as six guitar sounds or six organ sounds or some combination of these sounds. Electronic circuits that produce different sounds in response to the actuation of different switches are known. Conventional electronic organs include such circuits, and, more specifically, a device called the Mattel Sunsonic Drum includes such a circuit. The control knobs 30a and 30b adjust the volume and tone, respectively, of the sounds produced by the sound generating circuit 32.

The sound generating circuit 32 is connected to a memory/record circuit 46. The memory/record circuit 46 advantageously allows the sounds that were produced by the sound generating circuit 32 to be recorded and played back at a later time. The memory/record circuit 46 is controlled by the memory/record control switch 30*e* and the playback control switch 30*f*. When the memory/record control switch 30*e* is actuated, the sounds produced by the sound generating circuit 32 are stored in a memory or recorded. When the playback control switch 30*f* is actuated, the sounds that were recorded are played back. While the sounds are being played back, the suit 10 may be used to produce additional sounds, which are heard along with the sounds being played back.

As mentioned above, the sound generating circuit 32 is connected to the amplifier 34, which drives the speakers 36 and 38, and the transmitter 40, which is connected to an antenna 44. The amplifier 34 may also drive a headphone (not shown), which would be connected to the amplifier 34 through a detachable plug (not shown). Preferably, the amplifier 34 and the transmitter 40 are connected to the sound generating circuit 32 through control switches 30*c* and 30*d*, respectively. The control switches 30*c* and 30*d* are arranged so as to disconnect the transmitter when the amplifier is connected and to disconnect the amplifier when the transmitter is connected; this arrangement reduces the amount of power required from the battery 42 and permits the battery 42 to be used for a longer period of time.

Figure 4:
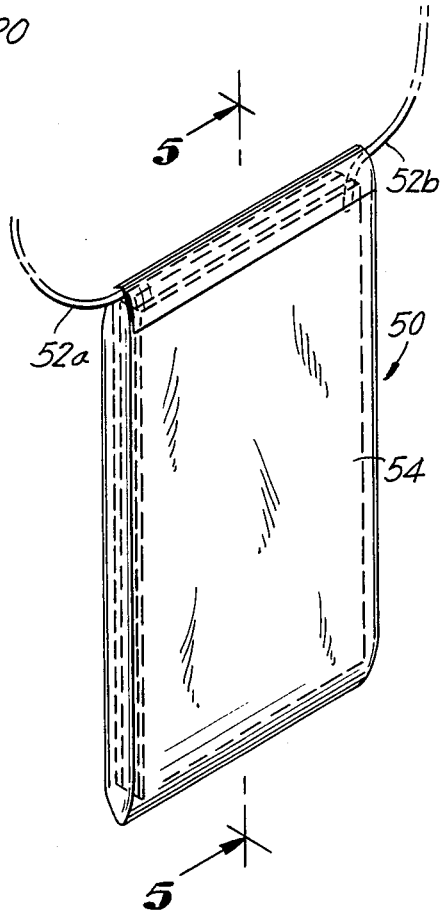
FIG. 4 is a perspective view of a switch for a sound generating outer garment according to the present invention.

As specified previously, FIGS. 4 through 6 illustrate a switch, which is generally designated by the reference numeral 50, that is adapted for use in a sound generating outer garment according to the present invention. The flexible switch 50 includes leads 52*a* and 52*b* and an outer cover 54. The switch 50 also includes a flexible and conductive outer lamina or layer 56 and a flexible and insulating outer lamina or layer 58. A flexible and resilient insulating cushion 60 is positioned between the outer layers 56 and 58. The insulating cushion 60 has several holes 62 therein. Additionally, several cone-shaped conductive projections 64 are mounted on the insulating outer layer 58. The projections 64 are aligned with and extend into the holes 62. Furthermore, the projections 64 are connected together by wires 66, which are advantageously coiled in order to allow them to flex along with the switch. The lead 52*a* is connected to the wires 66, while the lead 52*b* is connected to the conductive outer layer 56.

FIG. 5 depicts the switch 50 and its open or unactuated position. In this position, none of the projections 64 contacts the conductive outer layer 56. In contrast, FIG. 6 depicts the switch 50 in its closed or actuated position. In this position, at least one of the projections 64 contacts the conductive outer layer 56, thereby closing the switch. Although several of the projections 64 are shown touching the conductive outer layer 56 in FIG. 6, only one need touch to close the switch. The switch 50 is actuated by a force denoted by arrows 68. Such a force may be applied when an elbow or a knee is bent. Various materials may be employed for the conductive outer layer 56, the insulating outer layer 58, and the cushion 60 in order to adjust the flexibility or sensitivity of the switch 50 and match the switch to its location in the sound generating outer garment.

Although a particular illustrative embodiment of the present invention has been described herein with reference to the accompanying drawings, the present invention is not limited to that particular embodiment. Various changes and modifications may be made thereto by those skilled in the art without departing from the spirit or scope of the invention, which is defined by the appended claims.

I claim:

1. A sound generating outer garment, comprising an outer garment which is a jacket; a plurality of switches mounted in said jacket, a switch being positioned at each shoulder and at each elbow of said jacket; and sound generating means for generating a sound, said sound generating means being mounted in said outer garment, each of said switches being connected to said sound generating means, said sound generating means generating a sound in response to actuation of one of said switches.

2. The sound generating outer garment as recited in claim 1 further comprising a pair of pants; and a plurality of switches mounted in said pair of pants, each of said switches being connected to said sound generating means.

3. The sound generating outer garment as recited in claim 1, wherein a switch is positioned at each knee of said pair of pants.

4. The sound generating generating outer garment as recited in claim 1 wherein each of said switches comprises a first outer lamina, the first outer lamina being flexible and conductive; a second outer lamina, the second outer lamina being flexible and insulating; a flexible and resilient insulating cushion interposed between the first and second outer lamina, the insulating cushion having at least one hole formed through the thickness thereof; and at least one conductive projection mounted on the second outer lamina and positioned thereon to be in alignment with the hole formed in the insulating cushion, the switch being operable between a conductive first state wherein the projection is not in contact with the first outer lamina and a conductive second state wherein the projection is in contact with the first outer lamina.

5. The sound generating outer garment as recited in claim 4, wherein first outer lamina is more flexible than the second outer lamina.

6. The sound generating outer garment as recited in claim 5, wherein first outer lamina is constructed from phosphorus bronze and the second outer lamina is constructed from leather.

7. The sound generating garment as recited in claim 1 wherein each of said switches comprises a first outer lamina, the first outer lamina being flexible and conductive; a second outer lamina, the second outer lamina being flexible and insulating; a flexible and resilient insulating cushion interposed between the first and second outer laminas, the insulating cushion having a plurality of holes formed through the thickness thereof; and a plurality of conductive projections mounted on the second lamina, each of the conductive projections being positioned on the second outer lamina to be in alignment with a corresponding hole formed in the insulating cushion, each of the projections being electrically joined together by means of coiled conductive wires, the switch being operable between a non-conductive first stage wherein the projections are not in contact with the first outer lamina and a conductive second stage wherein at least one projection is in contact with the first outer lamina.

8. A sound generating garment, comprising a garment which is a selected one of a coat, a jacket and pants; a plurality of switches mounted in said garment, each of said switches being positioned at a selected one of a shoulder and an elbow when said garment is selected as one of the jacket and the coat; each of said switches being positioned at a knee in the pants when said garment is selected as pants; sound generating means for generating a sound, said sound generating means being mounted in said garment, each of said switches being connected to said sound generating means, said sound generating means generating a sound in response to actuation of one of said switches.

9. The sound generating garment as recited in claim 8, wherein said sound generating means generates a plurality of sounds and each one of said switches uniquely corresponds to each one of said sounds.

10. The sound generating garment as recited in claim 9, wherein said switch comprises a first outer lamina which is flexible and conductive; a second outer lamina which is flexible and insulating; a flexible and insulating cushion between said first and second outer lamina, said cushion having an opening therein; and a conductive projection mounted on said second outer lamina, said switch being operable by exerting pressure on said first or second outer lamina such that the conductive projection contacts the first outer lamina through said opening in said cushion to complete a circuit through said switch.

11. Apparatus for generating sound as recited in claim 8 wherein each of said switches comprises a first lamina which is flexible and conductive; a second lamina which is flexible and insulating; a flexible and insulating cushion between said first and second lamina, said cushion having an opening therein; and a conductive projection connected to said second lamina, said switch being operable between open and closed positions, said switch being in the opened position when said conductive projection is not in contact with said first lamina and said switch being in the closed position when pressure is exerted in said first or second lamina such that said conductive projection is in contact with the first lamina.

* * * * *